US007092652B2

(12) United States Patent
Matsumoto

(10) Patent No.: US 7,092,652 B2
(45) Date of Patent: Aug. 15, 2006

(54) DEVICE AND METHOD FOR CONTROLLING THE TURN-ON TIME OF PLURAL HEATER LAMPS

(75) Inventor: Hirotaka Matsumoto, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 51 days.

(21) Appl. No.: 10/873,138

(22) Filed: Jun. 23, 2004

(65) Prior Publication Data

US 2005/0286919 A1 Dec. 29, 2005

(51) Int. Cl.
*G03G 15/20* (2006.01)

(52) U.S. Cl. ..... 399/70; 399/69

(58) Field of Classification Search ..... 399/69, 399/70, 328, 330

See application file for complete search history.

(56) References Cited

U.S. PATENT DOCUMENTS

| | | | | |
|---|---|---|---|---|
| 5,819,134 | A * | 10/1998 | Sato et al. | 399/69 |
| 6,008,829 | A * | 12/1999 | Wakamiya et al. | 399/330 X |
| 6,311,028 | B1 * | 10/2001 | Matsudaira | 399/69 |
| 6,516,165 | B1 * | 2/2003 | Makihira et al. | 399/69 |
| 6,882,804 | B1 * | 4/2005 | Eskey | 399/330 X |
| 2001/0048822 | A1 * | 12/2001 | Hanyu et al. | 399/328 X |
| 2003/0215255 | A1 * | 11/2003 | Kinouchi et al. | 399/69 |

FOREIGN PATENT DOCUMENTS

JP 11-242404 A 9/1999

* cited by examiner

*Primary Examiner*—Sandra L. Brase
(74) *Attorney, Agent, or Firm*—Foley & Lardner LLP

(57) ABSTRACT

Following the end of warm-up, a control unit confirms whether the warm-up time is 10 seconds or more. If the warm-up time is 10 seconds or more, the control unit controls a maximum lamp turn-on time for alternate turn-on at 1.0 second as long as an idle time (t) from the end of warm-up is less than two minutes. When the idle time exceeds two minutes, the control unit controls the maximum lamp turn-on time for alternate turn-on at 2.5 seconds.

20 Claims, 8 Drawing Sheets

| WARM-UP TIME | IDLE TIME t | MAXIMUM LAMP TURN-ON TIME |
|---|---|---|
| CASE OF 10 SECONDS OR MORE | CASE OF 2 MINUTES OR LESS | 1.0 SECOND |
| | CASE OF MORE THAN 2 MINUTES | 2.5 SECONDS |
| CASE OF LESS THAN 10 SECONDS | REGARDLESS OF IDLE TIME | 2.5 SECONDS |

DEVICE AND METHOD FOR CONTROLLING THE TURN-ON TIME OF PLURAL HEATER LAMPS

BACKGROUND OF THE INVENTION

1. Field of the Invention

The present invention relates to a fixing device for fixing a toner image on a medium, on which the toner image is to be fixed, in an image forming apparatus such as an electronic copying machine or a laser printer, and to a control method for the fixing device.

2. Description of the Related Art

In recent years, there is known a roller-fixation type fixing device that uses a heat roller with a small wall thickness in order to shorten a warm-up time for environmental protection.

In the case of using the heat roller with a small wall thickness, however, a temperature variation increases. In particular, immediately after warm-up, non-uniformity in temperature of the heat roller becomes conspicuous. While the small-wall-thickness heat roller is being rotated, an undershoot phenomenon occurs due to absorption of the heat of the heat roller by a press roller or transfer paper, which is in contact with the heat roller. This may lead to a defective fixed image.

There is a case where a temperature difference in the longitudinal direction of the heat roller increases depending on the width of paper that is fed in a successive copy mode. In particular, in the case of using small-width paper of, e.g. A4-R size, the temperature of that part of the heat roller, at which the paper does not pass, that is, the temperature of end portions of the heat roller, rises to an abnormal level. This may lead to damage to structural parts or a defective image, such as a high-temperature offset image, at a time of the next copying.

To solve this problem, there is a technique wherein a plurality of heater lamps with different light distribution characteristics are used, thereby dividing to-be-heated parts of the heat roller.

If plural heater lamps are used, however, there may be a case where the heater lamps cannot be turned on at the same time, depending on operational conditions, and a turn-on control, such as alternate turn-on, may be required. In the case of alternate turn-on, the turn-on time of each lamp needs to be increased to cope with a problem of flicker. Consequently, in the case of the heat roller using a plurality of heater lamps, the temperature variation increases and a defective image, such as a defective fixed image, may be formed when the temperature drops, for example, immediately after warm-up.

Besides, there is such a problem that the warm-up time increases, if the temperature at a time immediately after warm-up is set at a high level in consideration of the drop in temperature.

BRIEF SUMMARY OF THE INVENTION

The object of an aspect of the present invention is to provide a fixing device capable of preventing a defect in fixation due to a non-uniform temperature of a heat roller and satisfying a countermeasure to flicker, and a control method for the fixing device.

According to an aspect of the present invention, there is provided a fixing device that is provided in an image forming apparatus and includes a heat roller and a press roller, the fixing device comprising: a plurality of heater lamps with different light distributions, which are disposed on an inner peripheral side of the heat roller; and a control unit that executes a control to control simultaneous turn-on of the plurality of heater lamps when power to the image forming apparatus is switched on, to stop the simultaneous turn-on at a time when a surface of the heat roller is heated up to a preset value by the control of the simultaneous turn-on, to determine a turn-on time for turning on one of the heater lamps in accordance with a time period between the start and stop of the simultaneous turn-on, and to alternately turn on the plurality of heater lamps with the determined turn-on time.

According to another aspect of the present invention, there is provided a control method for a fixing device that is provided in an image forming apparatus and includes a heat roller and a press roller, wherein a temperature of the heat roller is controlled using a first heater lamp that is provided within the heat roller and mainly heats a region of a first paper pass width for a paper sheet on which an image is to be formed by the image forming apparatus, and a second heater lamp that is provided within the heat roller and mainly heats a region of a second paper pass width that is different from the first paper pass width, the method comprising: controlling simultaneous turn-on of the first heater lamp and the second heater lamp when power to the image forming apparatus is switched on; stopping the simultaneous turn-on at a time when a surface of the heat roller is heated up to a preset value by the control of the simultaneous turn-on; determining a turn-on time for alternate turn-on of the first heater lamp and the second heater lamp in accordance with a time period between the start and stop of the simultaneous turn-on; and controlling the alternate turn-on of the first heater lamp and the second heater lamp with the determined turn-on time.

Additional objects and advantages of an aspect of the invention will be set forth in the description which follows, and in part will be obvious from the description, or may be learned by practice of the invention. The objects and advantages of an aspect of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the embodiments given below, serve to explain the principles of an aspect of the invention.

DETAILED DESCRIPTION OF THE INVENTION

An embodiment of the present invention will now be described with reference to the accompanying drawings.

Figure 1:
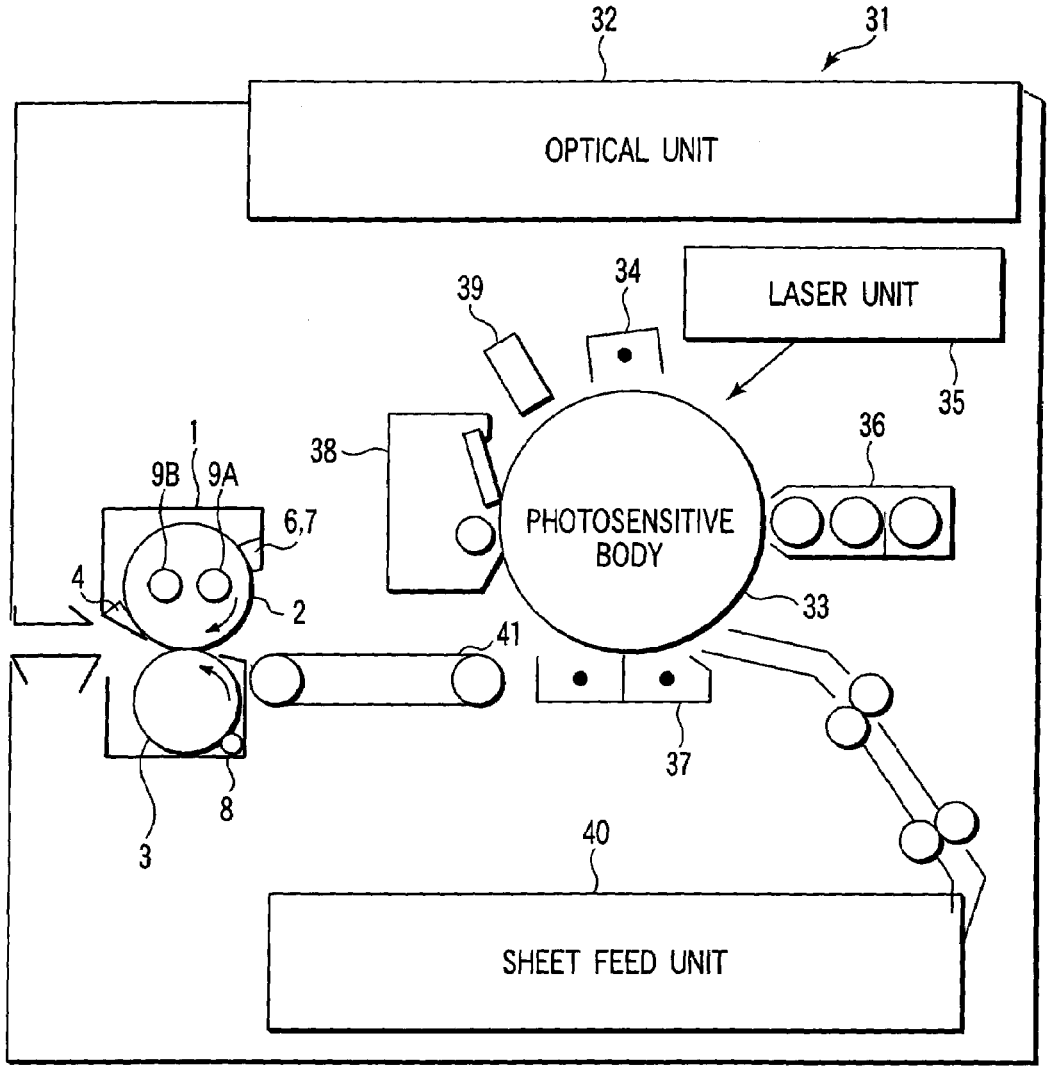
FIG. 1 is a cross-sectional view that schematically shows the structure of an image forming apparatus according to an embodiment of the present invention.

FIG. 1 schematically shows the structure of an image forming apparatus according to the embodiment of the invention. The image forming apparatus 31 comprises an optical unit 32, a photosensitive body 33, a charger 34, a laser unit 35, a developing unit 36, a transfer/separation charger 37, a cleaner 38, a charge erase lamp 39, a sheet feed unit 40, a convey belt 41 and a fixing device 1.

Since the present invention relates to the fixing device 1 in the image forming apparatus 31, a description of the structural elements other than the fixing device 1 is omitted.

The fixing device 1 includes a heat roller 2 and a press roller 3. The heat roller 2 has an outside diameter of 30 mm and the press roller 3 has an outside diameter of 30 mm.

The press roller 3 is put in pressure contact with the heat roller 2 by a pressing mechanism (not shown). A predetermined nip width is secured between the press roller 3 and heat roller 2. The heat roller 2 is driven in the direction of an arrow by a drive motor (not shown), and the press roller rotates in the direction of an arrow following the rotation of the heat roller 2.

The heat roller 2 is formed of aluminum and has a wall thickness of 0.8 mm. The surface of the heat roller 2 is coated with a release layer that is formed of, e.g. Teflon. The press roller 3 is configured such that the circumferential surface of a metal core is coated with silicone rubber, fluoro-rubber, etc.

A paper sheet passes through a pressure-contact part (nip part) between the heat roller 2 and press roller 3, whereby a developer on the sheet is fused under pressure and fixed.

On the downstream side of the contact point (nip portion) between the heat roller 2 and press roller 3 in the direction of rotation, there are provided a separating gripper 4 for separating the sheet (P) from the heat roller 3, and a center thermistor 6 and a side thermistor 7 that detect the temperature of the heat roller 2. The press roller 3 is provided with a cleaning roller 8.

The heat roller 2 is heated by a heater lamp system using halogen lamps (564 W per lamp). The heater lamps that serve as heating means of the heat roller 2 comprise a center lamp 9A and a side lamp 9B, which are disposed on the inner peripheral side of the heat roller 2. The center lamp 9A and side lamp 9B have different light distributions in accordance with heating positions of the heat roller 2.

Figure 2:
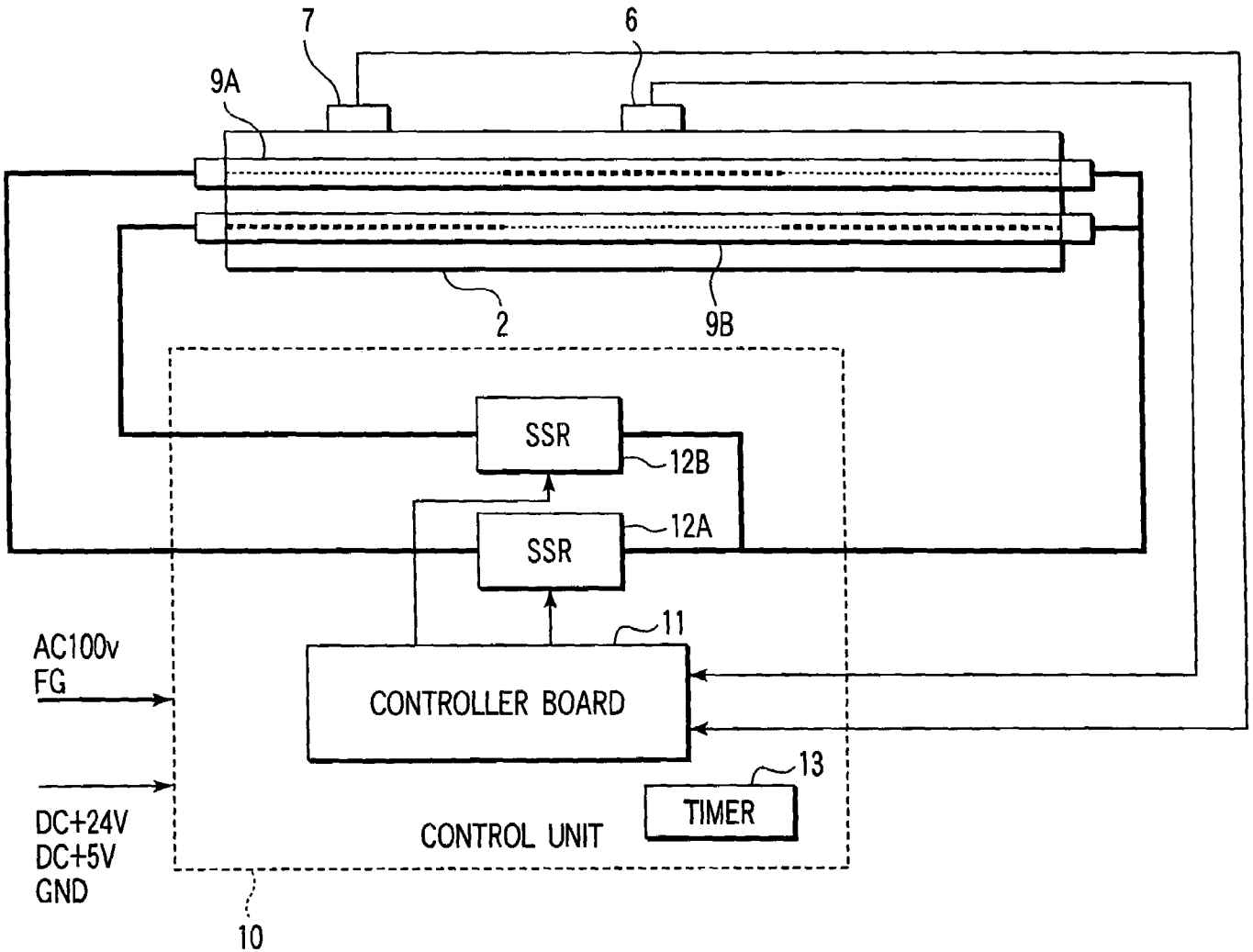
FIG. 2 is a block diagram illustrating the configuration of a heat roller temperature control.

FIG. 2 shows the configuration of a temperature control for the heat roller 2.

The heat roller 2 is provided with a center thermistor 6 serving as a temperature sensor at a central part thereof, and a side thermistor 7 serving as a temperature sensor at a side end part thereof. The above-mentioned center lamp 9A and side lamp 9B are disposed within the heat roller 2.

A control unit 10 serving as control means executes an overall control of the image forming apparatus 31. The control unit 10 is supplied with AC 100V, DC 24V and DC 5V from a power supply unit (not shown).

The control unit 10 includes a controller board 11 that controls the temperature of the heat roller 2, SSRs (Solid State Array) 12A and 12B, and a timer 13.

Responding to detection signals from the center thermistor 6 and side thermistor 7, the controller board 11 controls turn-on/off of the center lamp 9A via the SSR 12A, and controls turn-on/off of the side lamp 9B via the SSR 12B.

Figure 3:
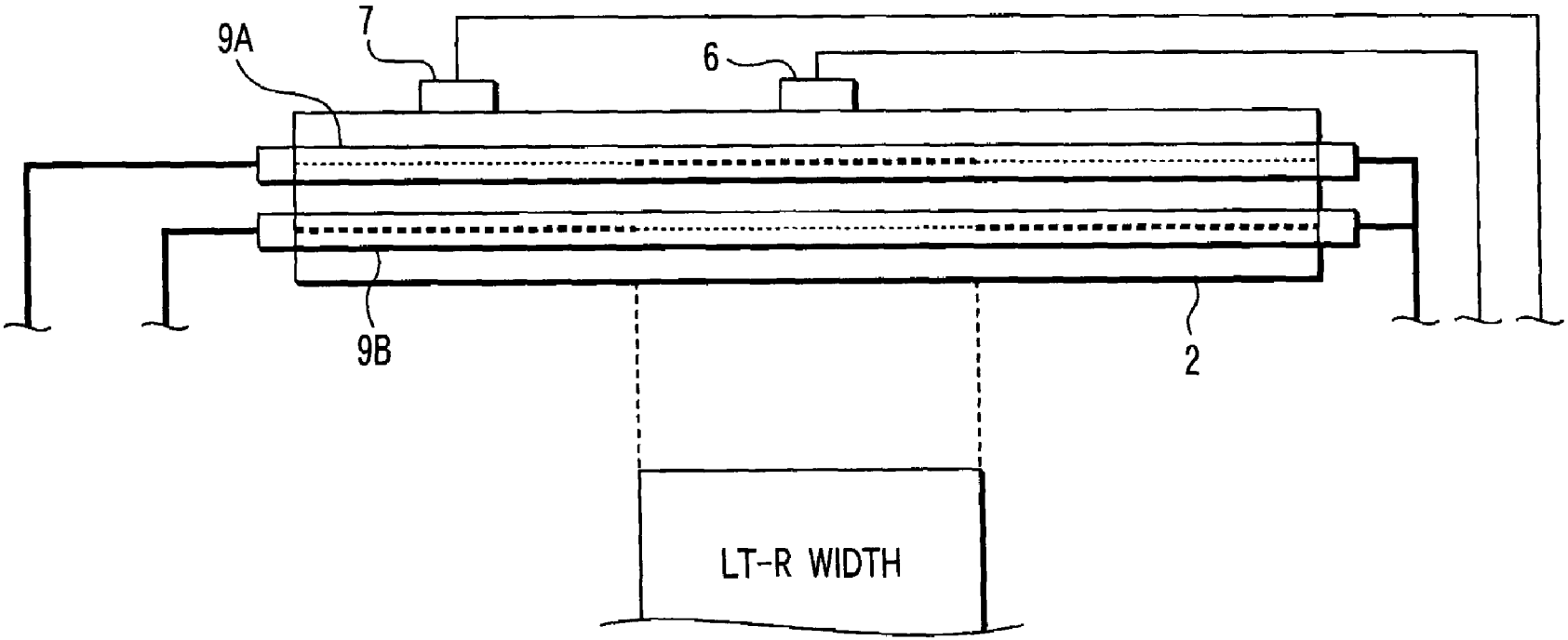
FIG. 3 shows a relationship in light distribution between a transfer paper width, a center lamp and a side lamp.

FIG. 3 shows a relationship in light distribution between a transfer paper width, center lamp 9A and side lamp 9B. The center lamp 9A is configured to mainly heat a region of a small-size-paper pass width (LT-R width or less) of the heat roller 2. The side lamp 9B is configured to mainly heat a region of a small-size-paper non-pass width (both end parts of heating roller 2) of the heat roller 2 at a time of passing large-size paper (with a width greater than LT-R width).

Figure 4:
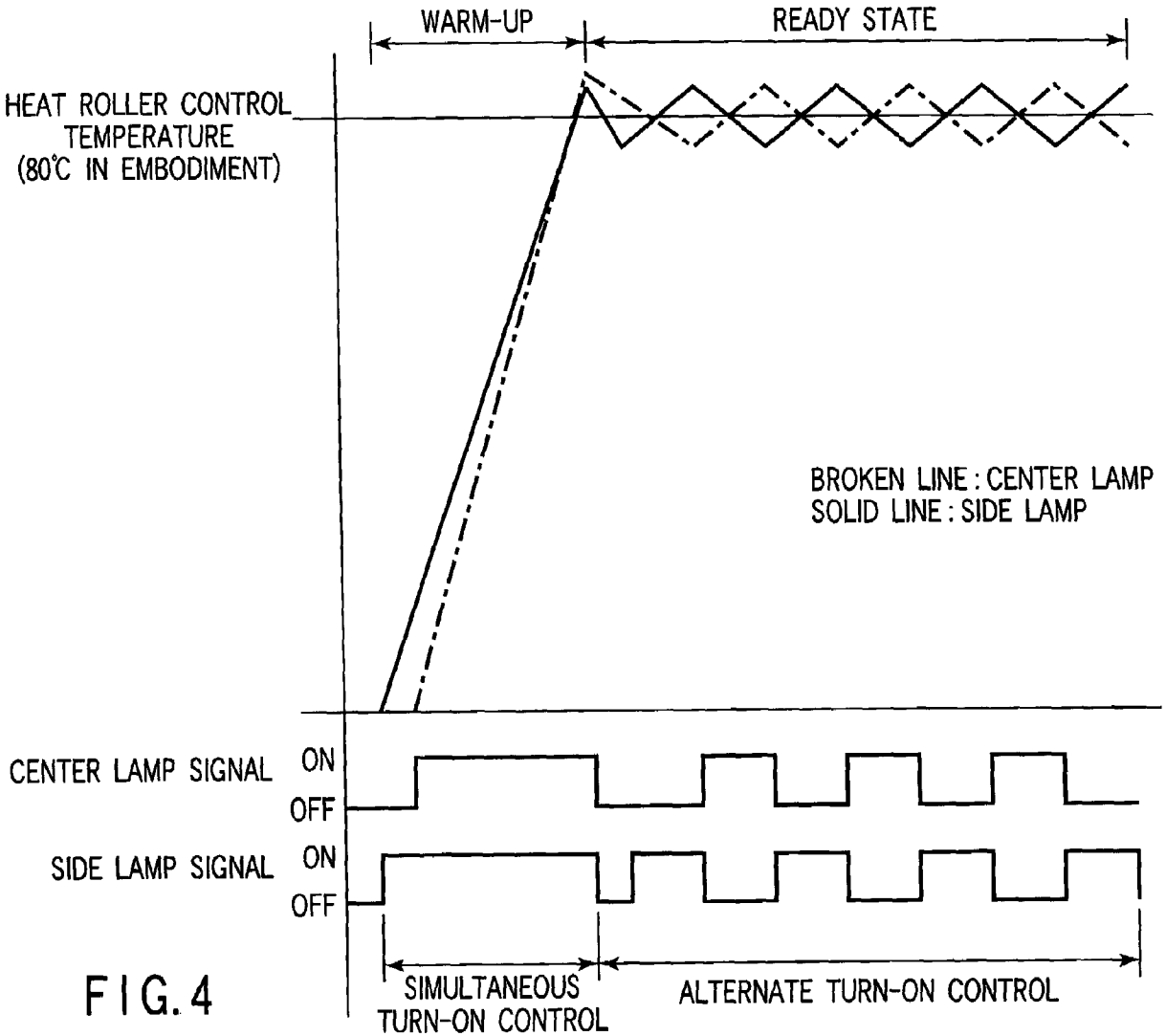
FIG. 4 illustrates a two-lamp turn-on control using a center lamp and a side lamp.

FIG. 4 illustrates a turn-on control of the two lamps, i.e. center lamp 9A and side lamp 9B. At a warm-up time when neither an original read (scan) operation nor an operation (copying operation) using a main motor is performed, a simultaneous turn-on control is executed. At a time of a ready-state or a copying operation, an alternate turn-on control is executed.

The surface temperature of the central part of the heat roller 2 is controlled at 180° C. by the center thermistor 6 and center lamp 9A, and the surface temperature of the side end parts of the heat roller 2 is controlled at 180° C. by the side thermistor 7 and side lamp 9B.

Figure 5:
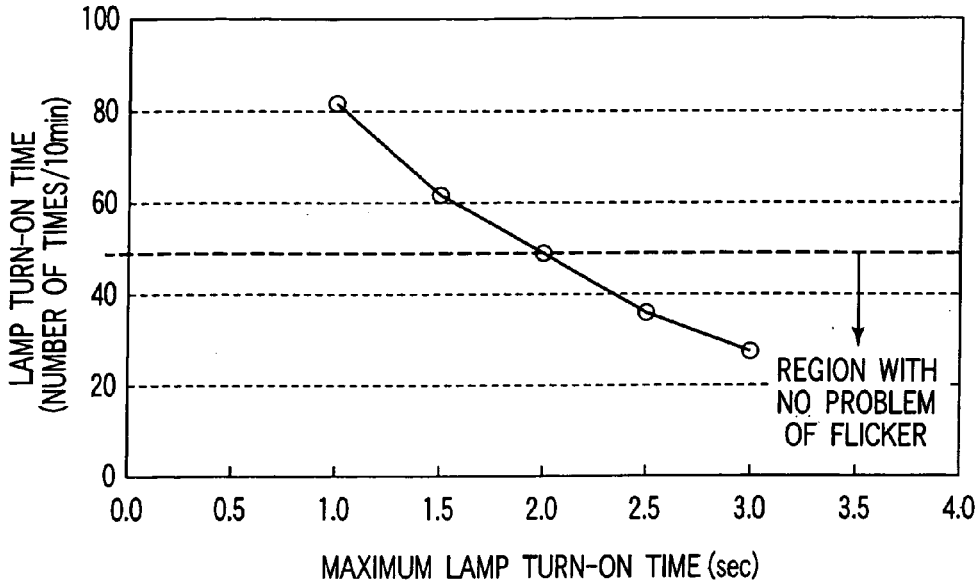
FIG. 5 is a graph showing a relationship between a maximum lamp turn-on time and the number of times of lamp turn-on operations.

FIG. 5 is a graph showing a relationship between a maximum lamp turn-on time and the number of times of lamp turn-on operations. As is shown in FIG. 5, in the alternate turn-on operation, in order to cope with a problem of flicker, it is necessary to set a maximum turn-on time of a single turn-on operation of each lamp at a large value. In order to prevent flicker, the lamp turn-on time needs to be less than 50 times/10 minutes.

In the present embodiment, the maximum turn-on time of each of the center lamp 9A and side lamp 9B is controlled at 2.5 seconds.

Figure 6:
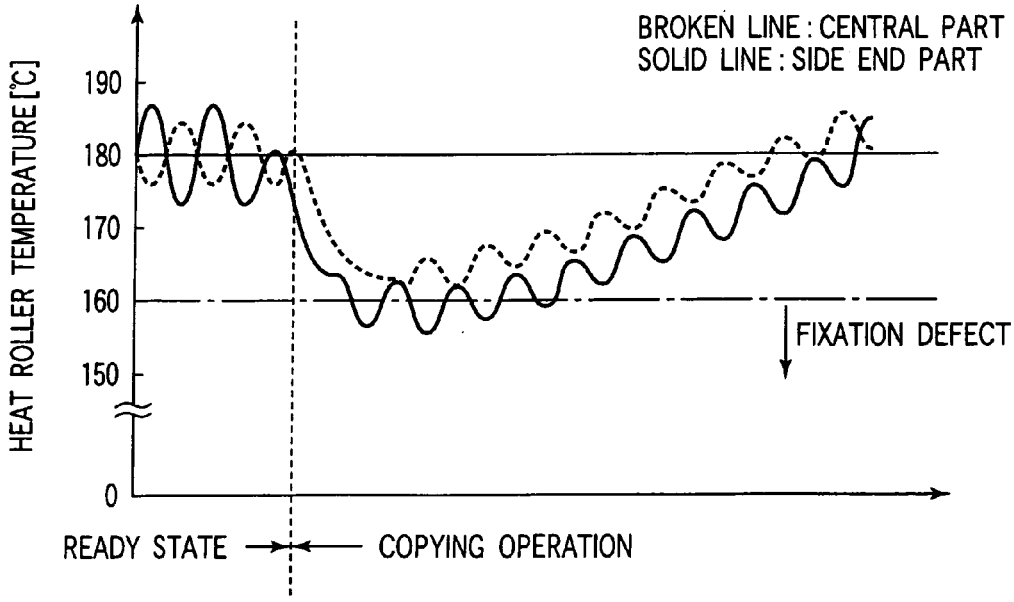
FIG. 6 (PRIOR ART)
FIG. 6 illustrates an alternate turn-on control using two conventional heater lamps.

FIG. 6 illustrates the alternate turn-on control using two conventional heater lamps. Specifically, FIG. 6 shows temperature variations of the heat roller in a case where the fixing device is warmed up from a cool state (i.e. room temperature in non-use state) and, immediately thereafter, a copying operation is performed. In this case, the surface temperature of the heat roller drops below a lower limit of 160° C., and a fixation defect occurs.

Figure 7:
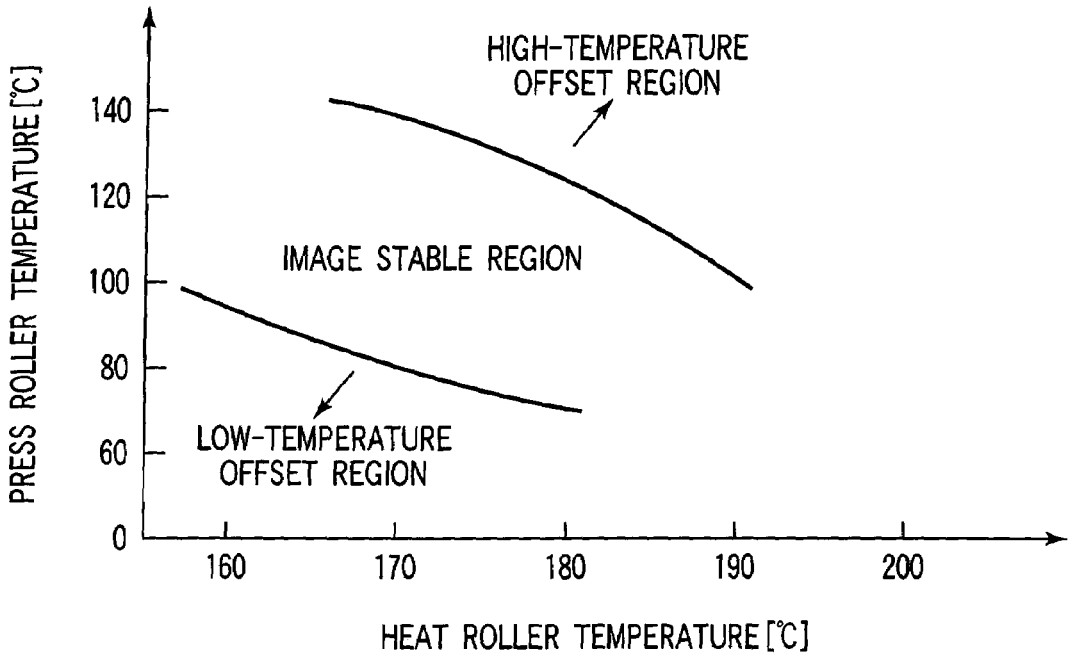
FIG. 7 is a graph illustrating a relationship between a heat roller temperature, a press roller temperature and a region where an image stain occurs.

FIG. 7 is a graph illustrating a relationship between the temperature of heat roller 2, the temperature of press roller 3, and a region where an image stain (surface stain) occurs. There are a low-temperature offset region and a high-temperature offset region, relative to an image stable region. It is thus necessary to control the surface temperature of the heat roller 2 so as to fall within the image stable region.

Figure 8:
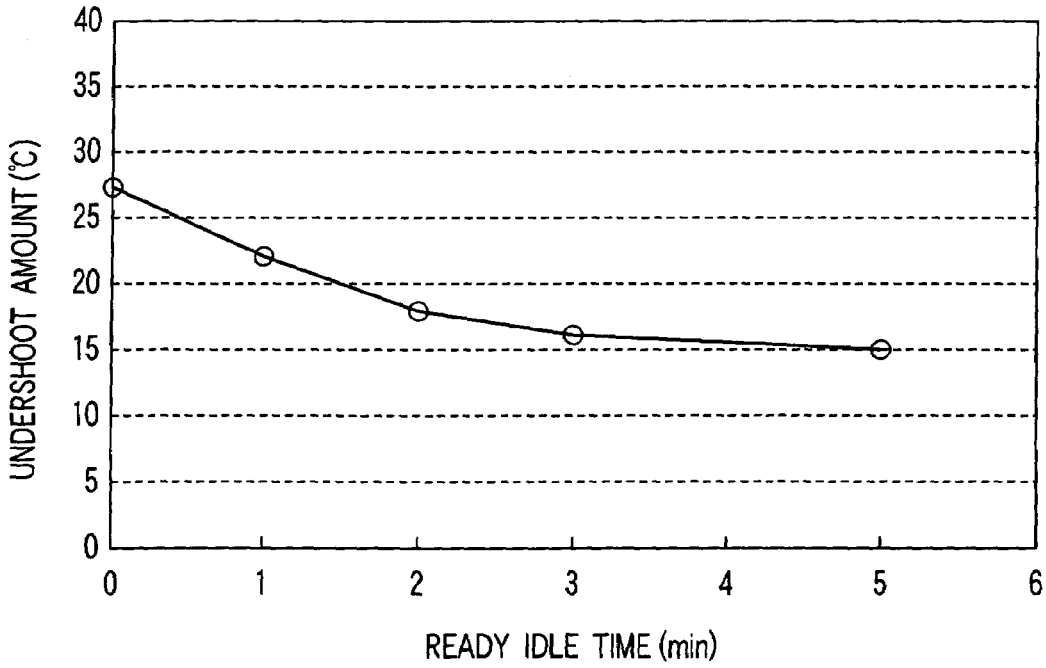
FIG. 8 is a graph showing a relationship between a ready-state idle time and an undershoot amount at a copy start time.

FIG. 8 is a graph showing a relationship between a ready-state idle time and a temperature variation at a copy start time (i.e. undershoot amount).

As is understood from FIGS. 6, 7 and 8, at a copying operation time immediately after completion of warm-up of the fixing device 1 from the cool state (room temperature), the amount of heat that is absorbed by the cooled press roller or a transfer paper sheet is large, and an undershoot phenomenon becomes conspicuous. Moreover, owing to non-uniformity in temperature resulting from, e.g. temperature ripple in the alternate lamp turn-on control, a problem of a defective image, such as fixation defect, occurs.

In order to solve this problem, the warm-up temperature may be raised in consideration of the undershoot amount immediately after warm-up. In this case, however, another problem, i.e. an increase in warm-up time, arises.

In the present embodiment, the following control is executed.

Figures 9, 10:
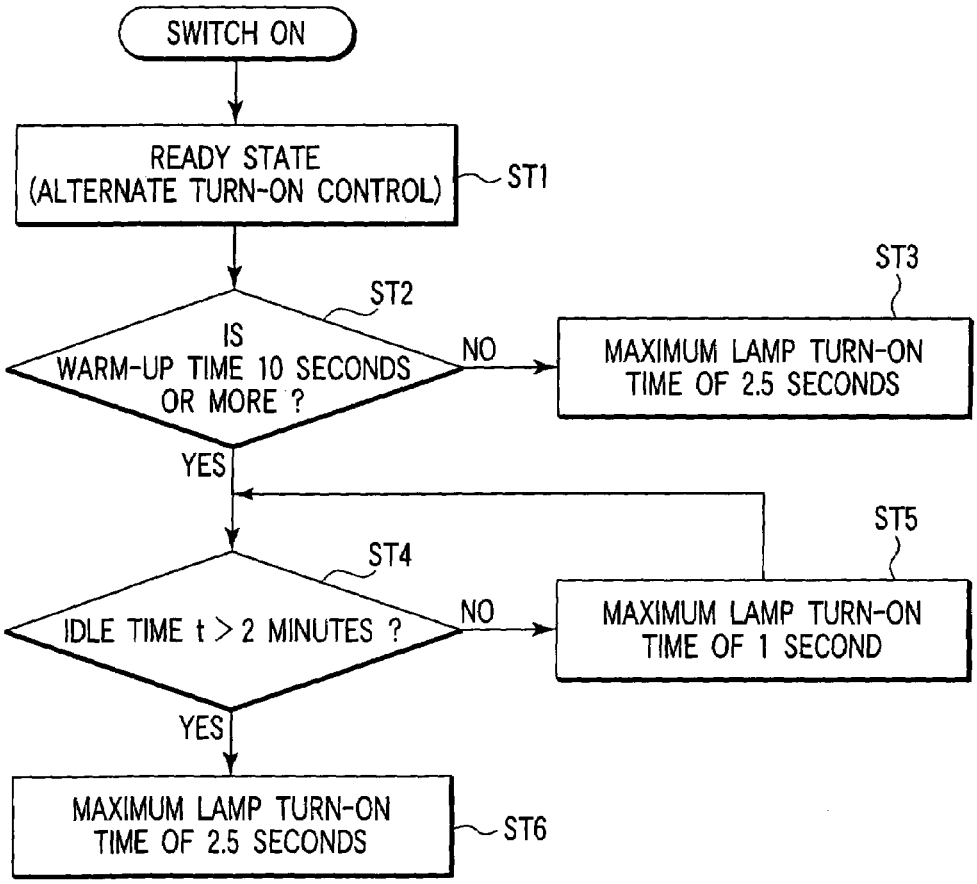
FIG. 9 is a table showing control conditions in the embodiment of the present invention.
FIG. 10 is a flow chart illustrating a temperature control operation in the fixing device.

FIG. 9 is a table showing control conditions in the embodiment of the present invention. In a case where the warm-up time is 10 seconds or more and the idle time t is two minutes or less, the maximum lamp turn-on time of each of the center lamp 9A and side lamp 9B in the alternate turn-on control is set at 1.0 second.

In a case where the warm-up time is 10 seconds or more and the idle time t exceeds two minutes, the maximum lamp turn-on time of each of the center lamp 9A and side lamp 9B in the alternate turn-on control is set at 2.5 seconds.

In a case where the warm-up time is less than 10 seconds, the maximum lamp turn-on time of each of the center lamp 9A and side lamp 9B in the alternate turn-on control is set at 2.5 seconds. This is such a case that the temperature of the fixing device 1 is higher than room temperatures because the heating temperature in the previous operation remains.

Next, the temperature control operation of the fixing device 1 with the above-described structure will now be described referring to a flow chart of FIG. 10.

To start with, when the power is switched on, the control unit 10 turns on the center lamp 9A and side lamp 9B through the controller board 11. In this case, the controller board 11 turns on both the center lamp 9A and side lamp 9B through the SSRs 12A and 12B. On the basis of detection signals from the center thermistor 6 and side thermistor 7, the control unit 10 continues the warm-up through the controller board 11 until the surface temperature of the heat roller 2 reaches a control temperature of 180° C. In this case, the control unit 10 measures, by means of the timer 13, the time period from the switch-on of power to the end of warm-up.

If the surface temperature of the heat roller 2 reaches the control temperature of 180° C., the control unit 10 transitions to the ready state and starts the alternate turn-on control for the center lamp 9A and side lamp 9B (ST1).

The control unit 10 confirms whether the warm-up time that is measured by the timer 13 is 10 seconds or more (ST2). If the warm-up time is less than 10 seconds, the control unit 10 controls the maximum lamp turn-on time for alternate turn-on at 2.5 seconds (ST3).

If the warm-up time is 10 seconds or more in step ST2, the control unit 10 confirms an idle time t in the ready state (ST4). In this case, too, the control unit 10 measures the time using the timer 13.

If the idle time t from the end of warm-up is less than two minutes (ST4), the control unit 10 controls the maximum lamp turn-on time for alternate turn-on at 1.0 second (ST5). The idle time t is preset at a predetermined time t after warm-up, regardless of the ready state or the copying state. In this embodiment, the idle time t is set at two minutes.

If the idle time t exceeds two minutes in step ST4, the control unit 10 controls the maximum lamp turn-on time for alternate turn-on at 2.5 seconds (ST6).

By executing the control of steps ST4 and ST5, it becomes possible to decrease the non-uniformity in temperature of the heat roller 2 immediately after warm-up, and the undershoot phenomenon at the time of a copying operation. Thereby, it becomes possible to eliminate a defect in image, such as a fixation defect, to provide stable image formation, and to satisfy a countermeasure to flicker.

Figure 11:
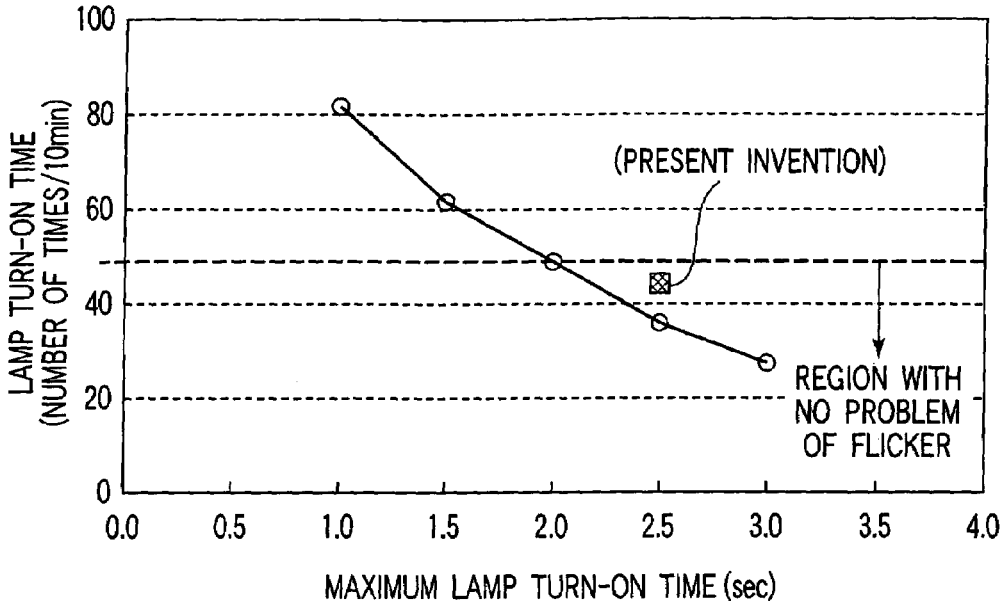
FIG. 11 is a graph for explaining a countermeasure to flicker after the application of the embodiment of the invention.

FIG. 11 is a graph for explaining a countermeasure to flicker after the application of the embodiment of the invention. As is understood from the relationship shown in FIG. 11 between the maximum lamp turn-on time and the number of times of lamp turn-on operations, the countermeasure to flicker can be satisfied by the above-described control of the present invention.

Figure 12:
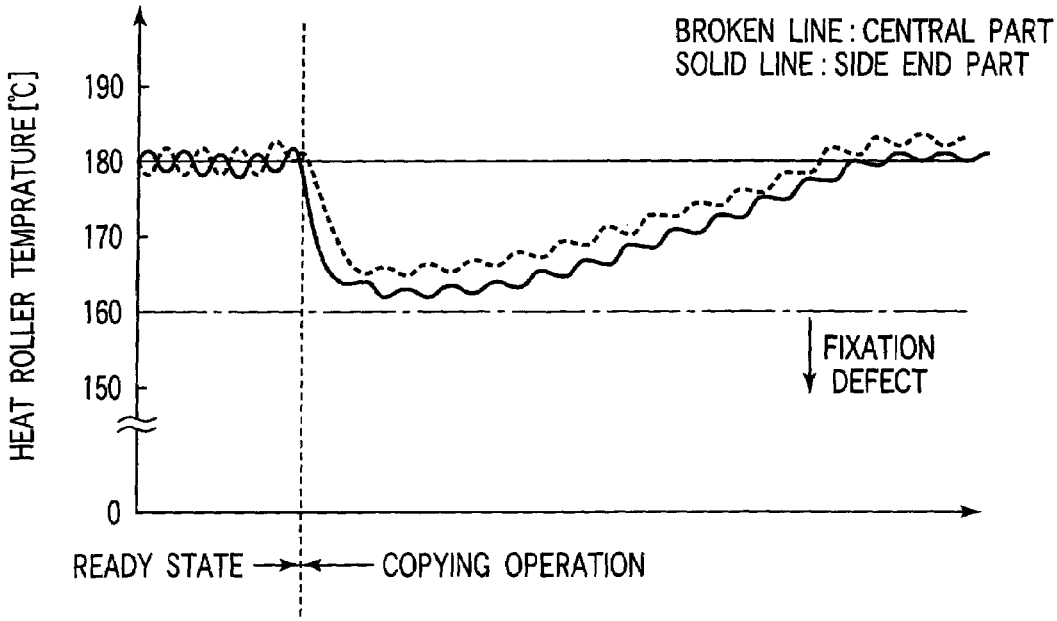
FIG. 12 is a graph illustrating an alternate turn-on control of the center lamp and side lamp according to the embodiment of the invention.

FIG. 12 is a graph illustrating the alternate turn-on control of the center lamp 9A and side lamp 9B according to the embodiment of the invention. Specifically, FIG. 12 shows temperature variations of the heat roller 2 in a case where the fixing device 1 is warmed up from a room-temperature state (10 seconds or more) and, immediately thereafter, a copying operation is performed. Under such a severest heating condition, as shown in FIG. 12, the surface temperature of the heat roller 2 does not fall below the lower limit of 160° C. at which a fixation defect may occur.

In the above-described embodiment, the temperature control of the heat roller from the cool state (room-temperature state), in which the fixing device is cooled at the time of switch-on, is determined on the basis of the warm-up time. In other words, if the warm-up time is 10 seconds or more, it is determined that the fixing device is in the cool state (room temperature).

In the above embodiment, two heater lamps are employed to heat the heat roller. Alternatively, three or more heater lamps may be used. In this case, too, the simultaneous turn-on control and alternate turn-on control are executed.

As has been described above, according to the embodiment of the invention, if it is determined that the fixing device is in the cool state (room-temperature state), the maximum lamp turn-on time for alternate turn-on control is set at a value less than in normal cases, regardless of the ready state or the copying state, within a predetermined time period (in which an undershoot phenomenon is conspicuous) after a preset temperature is reached following the switch-on of power. Thereby, it becomes possible to decrease the non-uniformity in temperature of the heat roller immediately after warm-up, and the undershoot phenomenon at the time of a copying operation. Hence, it becomes possible to eliminate a defect in image, such as a fixation defect, to provide stable image formation, and to satisfy a countermeasure to flicker.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A fixing device that is provided in an image forming apparatus and includes a heat roller and a press roller, the fixing device comprising:

a plurality of heater lamps with different light distributions, which are disposed on an inner peripheral side of the heat roller; and a control unit that executes a control to control simultaneous turn-on of said plurality of heater lamps when power to the image forming apparatus is switched on, to stop the simultaneous turn-on at a time when a surface of the heat roller is heated up to a preset value by the control of the simultaneous turn-on, to determine a turn-on time for turning on one of the heater lamps in accordance with a time period between the start and stop of the simultaneous turn-on, and to alternately turn on said plurality of heater lamps with the determined turn-on time.

2. A fixing device that is provided in an image forming apparatus and includes a heat roller and a press roller, the fixing device comprising:

a first heater lamp that is provided within the heat roller and mainly heats a region of a first paper pass width for a paper sheet on which an image is to be formed by the image forming apparatus;

a second heater lamp that is provided within the heat roller and mainly heats a region of a second paper pass width that is different from the first paper pass width; and a control unit that controls simultaneous turn-on of the first heater lamp and the second heater lamp when power to the image forming apparatus is switched on, stops the simultaneous turn-on at a time when a surface of the heat roller is heated up to a preset value by the control of the simultaneous turn-on, determines a turn-on time for alternate turn-on of the first heater lamp and the second heater lamp in accordance with a time period between the start and stop of the simultaneous turn-on, and controls the alternate turn-on of the first heater lamp and the second heater lamp with the determined turn-on time.

3. The fixing device according to claim 2, wherein the first heater lamp heats a central part of the heat roller, the central part of the heat roller having a size equal to or less than an LT-R width of a sheet size.

4. The fixing device according to claim 2, wherein the second heater lamp heats both end parts of the heat roller, which excludes a central part of the heat roller having an LT-R width of a sheet size.

5. The fixing device according to claim 2, wherein the control unit determines whether the surface of the heat roller reaches the preset temperature using a sensor that detects surface temperatures of a central part and a side end part of the heat roller.

6. The fixing device according to claim 2, wherein the control unit determines, on the basis of the time period between the start and stop of the simultaneous turn-on control, whether the alternate turn-on is to be executed with a first turn-on time or the alternate turn-on is to be executed with a second turn-on time.

7. The fixing device according to claim 2, wherein the control unit determines, on the basis of the time period between the start and stop of the simultaneous turn-on control, whether the alternate turn-on is to be executed with a turn-on time of one second or the alternate turn-on is to be executed with a turn-on time of 2.5 seconds.

8. The fixing device according to claim 2, wherein the control unit determines, on the basis of the time period between the start and stop of the simultaneous turn-on control, whether the alternate turn-on is controlled with a turn-on time of 2.5 seconds after the alternate turn-on is controlled with a turn-on time of one second for a predetermined time period, or the alternate turn-on is controlled with a turn-on time of 2.5 seconds from the beginning.

9. The fixing device according to claim 2, wherein the control unit controls the alternate turn-on with a turn-on time t1 for one turn-on operation, which satisfies a countermeasure to flicker with respect to a number of times of turn-on operations within a predetermined time period of the first heater lamp and the second heater lamp, and controls the alternate turn-on with a turn-on time t2 that is less than the turn-on time t1 in a case where initial fixing properties of the heat roller and the press roller fail to be secured.

10. A fixing device that is provided in an image forming apparatus and includes a heat roller and a press roller, the fixing device comprising:

first heating means that is provided within the heat roller and mainly heats a region of a first paper pass width for a paper sheet on which an image is to be formed by the image forming apparatus;

second heating means that is provided within the heat roller and mainly heats a region of a second paper pass width that is different from the first paper pass width; and control means that controls simultaneous heating of the first heating means and the second heating means when power to the image forming apparatus is switched on, stops the simultaneous heating at a time when a surface of the heat roller is heated up to a preset value by the control of the simultaneous heating, determines a heating time for alternately heating the first heating means and the second heating means in accordance with a time period between the start and stop of the simultaneous heating, and controls the alternate heating of the first heating means and the second heating means with the determined heating time.

11. The fixing device according to claim 10, wherein the first heating means heats a central part of the heat roller, the central part of the heat roller having a size equal to or less than an LT-R width of a sheet size.

12. The fixing device according to claim 10, wherein the second heating means heats both end parts of the heat roller, which excludes the a central part of the heat roller having an LT-R width of a sheet size.

13. The fixing device according to claim 10, wherein the control means determines whether the surface of the heat roller reaches the preset temperature using sensor means that detects surface temperatures of a central part and a side end part of the heat roller.

14. The fixing device according to claim 10, wherein the control means determines, on the basis of the time period between the start and stop of the simultaneous heating control, whether the alternate heating is to be executed with a first heating time or the alternate mm-on is to be executed with a second heating time.

15. The fixing device according to claim 10, wherein the control means determines, on the basis of the time period between the start and stop of the simultaneous heating control, whether the alternate heating is to be executed with a heating time of one second or the alternate heating is to be executed with a heating time of 2.5 seconds.

16. The fixing device according to claim 10, wherein the control means determines, on the basis of the time period between the start and stop of the simultaneous heating control, whether the alternate heating is controlled with a heating time of 2.5 seconds after the alternate heating is controlled with a heating time of one second for a predetermined time period, or the alternate heating is controlled with a heating time of 2.5 seconds from the beginning.

17. The fixing device according to claim 10, wherein the control means controls the alternate heating with a heating time t1 for one heating operation, which satisfies a countermeasure to flicker, with respect to a number of times of heating operations within a predetermined time period of the first heating means and the second heating means, and controls the alternate heating with a heating time t2 that is less than the heating time t1 in a case where initial fixing properties of the heat roller and the press roller fail to be secured.

18. A control method for a fixing device that is provided in an image forming apparatus and includes a heat roller and a press roller, wherein a temperature of the heat roller is controlled using a first heater lamp that is provided within the heat roller and mainly heats a region of a first paper pass width for a paper sheet on which an image is to be formed by the image forming apparatus, and a second heater lamp that is provided within the heat roller and mainly heats a region of a second paper pass width that is different from the first paper pass width, the method comprising:

controlling simultaneous turn-on of the first heater lamp and the second heater lamp when power to the image forming apparatus is switched on;

stopping the simultaneous turn-on at a time when a surface of the heat roller is heated up to a preset value by the control of the simultaneous turn-on;

determining a turn-on time for alternate turn-on of the first heater lamp and the second heater lamp in accordance with a time period between the start and stop of the simultaneous turn-on; and controlling the alternate turn-on of the first heater lamp and the second heater lamp with the determined turn-on time.

19. The control method for a fixing device, according to claim 18, wherein it is determined, on the basis of the time period between the start and stop of the simultaneous turn-on control, whether the alternate turn-on is to be executed with a first turn-on time or the alternate turn-on is to be executed with a second turn-on time.

20. The control method for a fixing device, according to claim 18, wherein it is determined, on the basis of the time period between the start and stop of the simultaneous turn-on control, whether the alternate turn-on is controlled with a turn-on time of 2.5 seconds after the alternate turn-on is controlled with a turn-on time of one second for a predetermined time period, or the alternate turn-on is controlled with a turn-on time of 2.5 seconds from the beginning.

* * * * *